US009123294B2

(12) United States Patent
Han et al.

(10) Patent No.: US 9,123,294 B2
(45) Date of Patent: Sep. 1, 2015

(54) ORGANIC LIGHT EMITTING DIODE DISPLAY DEVICE

(75) Inventors: Inhyo Han, Chungbuk (KR); Hyunhaeng Lee, Gyeongbuk (KR); Sungman Han, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 831 days.

(21) Appl. No.: 13/408,946

(22) Filed: Feb. 29, 2012

(65) Prior Publication Data

US 2013/0043802 A1 Feb. 21, 2013

(30) Foreign Application Priority Data

Aug. 17, 2011 (KR) ..... 10-2011-0081701

(51) Int. Cl.
*H05B 37/00* (2006.01)
*G09G 3/32* (2006.01)

(52) U.S. Cl.
CPC ..... *G09G 3/3233* (2013.01); *G09G 2300/0819* (2013.01); *G09G 2300/0852* (2013.01); *G09G 2300/0861* (2013.01); *G09G 2320/045* (2013.01)

(58) Field of Classification Search
None
See application file for complete search history.

(56) References Cited

U.S. PATENT DOCUMENTS

| | | | | |
|---|---|---|---|---|
| 2003/0112208 | A1* | 6/2003 | Okabe et al. | 345/82 |
| 2006/0208979 | A1* | 9/2006 | Fish et al. | 345/81 |
| 2009/0309503 | A1* | 12/2009 | Kim | 315/169.3 |
| 2010/0134338 | A1 | 6/2010 | Belz et al. | |
| 2010/0134388 | A1* | 6/2010 | Maekawa et al. | 345/76 |
| 2011/0095967 | A1 | 4/2011 | Choi | |
| 2011/0227903 | A1 | 9/2011 | Choi | |

FOREIGN PATENT DOCUMENTS

| | | | |
|---|---|---|---|
| EP | 2 136 353 | A1 | 12/2009 |
| EP | 2423909 | A1 | 2/2012 |

OTHER PUBLICATIONS

State Intellectual Property Office of the People's Republic of China, First Office Action, Chinese patent Application No. 201210080316.7, Jun. 18, 2014, eighteen pages.
GB Office Action, GB Application No. 1206846.6, Aug. 13, 2012, 6 pages.
German Patent and Trademark Office, Office Action, German Patent Application No. 10 2012 105 107.0, fifteen pages.
United Kingdom Intellectual Property Office, Examination Report, Patent Application No. GB 1206846.6, Nov. 14, 2013, three pages.

* cited by examiner

*Primary Examiner* — Long Nguyen
(74) *Attorney, Agent, or Firm* — Fenwick & West LLP

(57) ABSTRACT

This disclosure relates to a display device that compensates for a threshold voltage of a driving TFT, a voltage drop of a supply voltage source, and a mobility of the driving TFT. The display device can include a plurality of pixels. At least one pixel can include components such as a first capacitor, a second capacitor, a data transistor, a control transistor, an emission transistor, an initialization transistor, a driving transistor and a light emitting diode (LED) among other components.

21 Claims, 11 Drawing Sheets

ORGANIC LIGHT EMITTING DIODE DISPLAY DEVICE

CROSS-REFERENCE TO RELATED APPLICATIONS

This application claims the benefit of Korean Patent Application No. 10-2011-0081701 filed on Aug. 17, 2011, which is hereby incorporated by reference in its entirety.

BACKGROUND

1. Field of the Invention

This document relates to an organic light emitting diode (OLED) display device that can compensate for a threshold voltage of a driving thin film transistor (TFT), a voltage drop of a supply voltage, and the mobility of the driving TFT.

2. Discussion of the Related Art

In recent years there has been an increasing demand for display devices. Various flat panel displays such as liquid crystal displays (LCDs), plasma display panels (PDPs), and organic light emitting diodes (OLED) displays have been widely used to meet this demand. Compared to other flat panel displays, OLED display devices are driven at a lower voltage, are thinner, have a wider viewing angle and a quicker response speed.

One specific type of OLED display device is an active matrix OLED display device. Active matrix OLED display devices have a plurality of pixels disposed in a matrix form to display an image. The plurality of pixels of an active matrix OLED display are defined by scan lines and data lines. Each pixel includes a scan thin film transistor (TFT) supplying data voltages from data line in response to scan signal from the scan line. Each pixel also includes a driving TFT controlling the amount of current supplied to an OLED in response to the data voltage supplied to a gate electrode of the driving TFT. The current Ids between the drain and source of the driving TFT supplied to the organic light emitting diode can be represented by Equation 1:

$$I_{ds}=k'\cdot(V_{gs}-V_{th})^2 \quad \text{[Equation 1]}$$

In equation 1, k' indicates a proportionality factor determined by the structure and physical properties of the driving TFT, Vgs indicates a voltage difference between a gate and a source of the driving TFT, and Vth indicates a threshold voltage of the driving TFT.

However, due to a threshold voltage shift caused by deterioration of the driving TFT, the threshold voltage Vth of the driving TFT of each of the pixels has a different value. The current Ids between the drain and source of the driving TFT is dependent on the threshold voltage Vth of the driving TFT. Thus, the current Ids between the drain and source of the driving TFT of each pixel varies even if the same data voltage is supplied to each of the pixels. Accordingly, there arises the problem that the luminance of light emitted from the OLED of each of the pixels varies even if the same data voltage is supplied to each of the pixels. To solve this problem, various types of pixel structures for compensating the threshold voltage of the driving TFT of each of the pixels have been proposed.

SUMMARY

In one embodiment, a display pixel comprises a first capacitor, a data transistor, a control transistor, and a driving transistor. The first capacitor is coupled between a first node of the pixel and a second node of the pixel. A gate of the driving transistor is coupled to the first node and a source of the driving transistor is coupled to the second node. The data transistor sets the first node to a data voltage level when turned on. For example, the data voltage level may represent an intended intensity level of the pixel. The control transistor sets the second node to a high supply voltage level when turned on. Setting the second node to the high supply voltage level causes, via the first capacitor coupled between the first and second nodes, an adjustment in the data voltage at the first node that generates an adjusted data voltage at the first node. The adjusted data voltage is applied to the gate of the driving transistor to control current in a light emitting diode (LED). The adjusted data voltage may account for the threshold voltage Vth of the driving transistor and variance in VDD across the display panel such that Vth and VDD are both compensated for.

In one embodiment, the display pixel also includes an initialization transistor coupled to the first node. The initialization transistor is configured to set the first node to a reference voltage responsive to turning on of the initialization transistor. The initialization transistor then turns off to float the first node. The data transistor is configured to set the first node to a data voltage after first node is floated. A second capacitor is coupled between the second node and the supply voltage, and a voltage change in the second node caused by setting the first node to the data voltage is based on a ratio of capacitance values of the first and second capacitors.

In one embodiment an emission transistor is coupled to the LED. The emission transistor is configured to enable a current path between the driving transistor and the LED responsive to turning on of the emission transistor. In one embodiment, a bypass transistor is also coupled to the LED to divert current from the LED responsive to turning on of the bypass transistor.

In one embodiment, a method of operation in a display pixel is disclosed. The display pixel has a driving transistor where a gate of the driving transistor is coupled to a first node and a source of the driving transistor coupled to a second node. The first node is set to a data voltage. The second node is set to a supply voltage. Setting the second node to a supply voltage causes, via a capacitor coupled between the first and second nodes, an adjustment in the data voltage at the first node that generates an adjusted data voltage at the first node. The adjusted data voltage is applied to the gate of the driving transistor to control current in a light emitting diode (LED).

BRIEF DESCRIPTION OF THE DRAWINGS

The teachings of the embodiments herein can be readily understood by considering the following detailed description in conjunction with the accompanying drawings.

DETAILED DESCRIPTION

Figure 1:
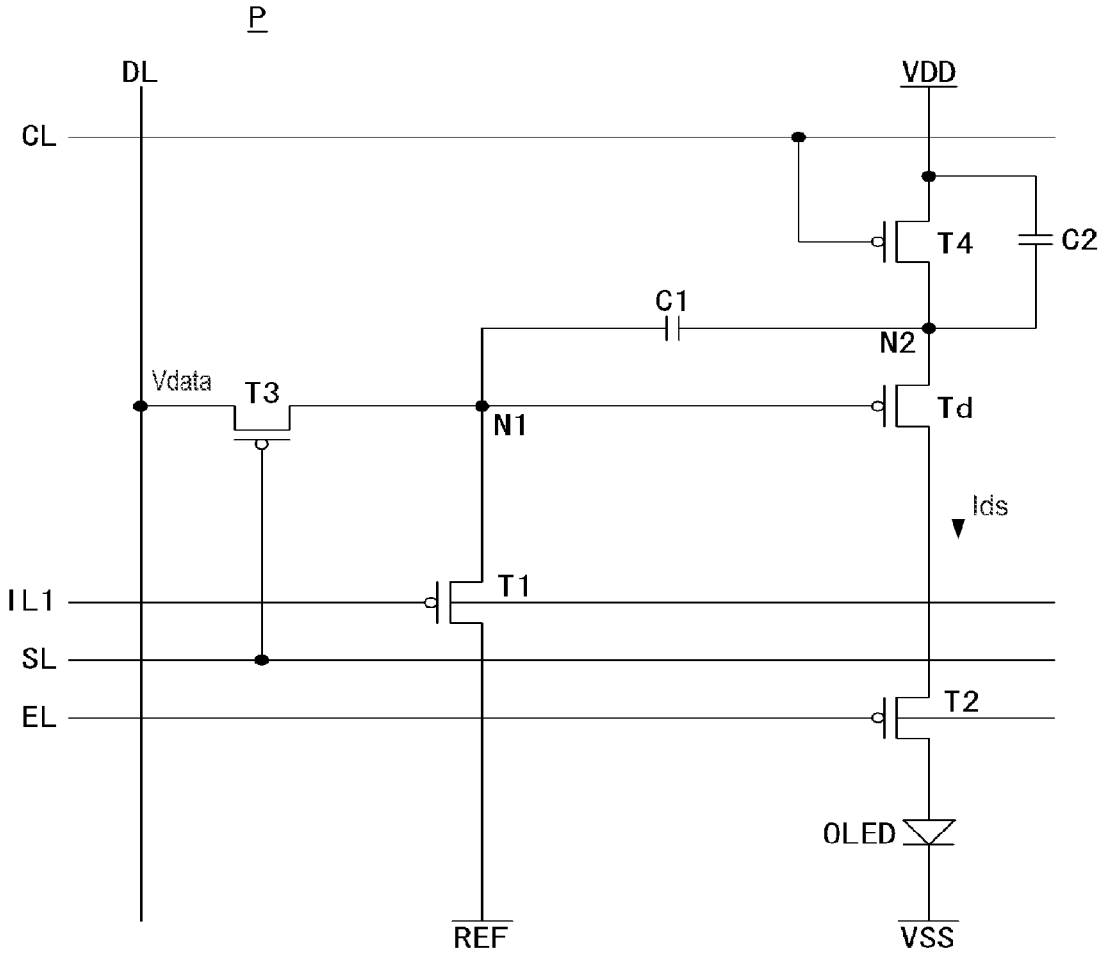
FIG. 1 is an equivalent circuit diagram of a pixel of a display panel according to a first exemplary embodiment.

Hereinafter, embodiments of this document will be described in detail with reference to the accompanying drawings. Like reference numerals may designate like elements throughout the specification. In the following description, detailed description of well-known functions or configurations may be omitted for clarity. Names of the respective elements used in the following explanations are selected for convenience only and may be thus different from those in actual products FIG. 1 is an equivalent circuit diagram of a pixel of a display panel according to a first exemplary embodiment. Referring to FIG. 1, a pixel P of a display panel 10 according to the first exemplary embodiment is defined by several pulse lines and a data line DL which intersect with each other. The pulse lines comprise a scan line SL, a control line CL, an emission line EL, and a first initialization line IL1. The pixel P also comprises a driving TFT Td, an organic light emitting diode OLED, and a control circuit that comprises first to fourth TFTs T1, T2, T3, and T4.

The first TFT T1 is an initialization transistor that is turned on or off in response to a first initialization signal (INI1) of the first initialization line IL1 to initialize a first node N1 of the pixel P to a reference voltage REF. A gate electrode of the first TFT T1 is coupled to the first initialization line IL1, a source electrode of the TFT T1 is coupled to the first node N1, and a drain electrode of the TFT T1 is coupled to reference voltage REF.

A second TFT T2 is an emission transistor that is turned on and off in response to an emission signal (EM) from the emission line EL to connect the driving TFT Td and the organic light emitting diode OLED. Connecting the driving TFT Td and the OLED enables a current path between the TFT Td and the OLED so that current can flow through the OLED. A gate electrode of the second TFT T2 is coupled to the emission line EL, a source electrode of the TFT T2 is coupled to a drain electrode of the driving TFT Td, and a drain electrode of the TFT T2 is coupled to an anode electrode of the organic light emitting diode OLED.

A third TFT T3 is a data transistor that is turned on or off in response to a scan signal (SS) from the scan line SL to supply a data voltage Vdata from the data line DL to the first node N1. The data voltage Vdata represents an intended intensity level of the OLED. The data voltage Vdata is used to set the voltage level at node N1 to the data voltage Vdata level, which in turn affects the current Ids flowing through the driving TFT Td and a brightness of the OLED. A gate electrode of the third TFT T3 is coupled to the scan line SL, a source electrode of the TFT T3 is coupled to the first node N1, and a drain electrode of the TFT T3 is coupled to the data line DL.

A fourth TFT T4 is a control transistor that is turned on or off in response to a control signal (CTR) from the control line CL to charge the second node N2 with a high supply voltage VDD. A gate electrode of the fourth TFT T4 is coupled to the control line CL, a source electrode of the TFT T4 is coupled to a high supply voltage VDD terminal, and a drain electrode of the TFT T4 is coupled to the second node N2.

A gate electrode of the driving TFT Td is coupled to the first node N1, a source electrode of the TFT Td is coupled to the second node N2, and a drain electrode of the TFT Td is coupled to the source electrode of the second TFT T2. The driving TFT Td controls the amount of current Ids between the drain and the source depending on the magnitude of the voltage applied to the gate electrode of the TFT Td.

The first to fourth TFTs T1, T2, T3, and T4 and driving TFT Td of the pixel P according to the first exemplary embodiment each may be composed of a thin film transistor. Semiconductor layers of the first to fourth TFTs T1, T2, T3, and T4 and driving TFT Td each may be composed of any one of amorphous silicon (a-Si), polycrystalline silicon (poly-Si), and oxide semiconductor. Moreover, the first exemplary embodiment has been described focusing on an example in which the first to fourth TFTs T1, T2, T3, and T4 and the driving TFT Td each are implemented as a P-type MOS-FET. In other embodiments, one or more of the TFTs may be implemented with N-type MOS-FETs.

The anode electrode of the organic light emitting diode OLED is coupled to the drain electrode of the second TFT T2, and a cathode electrode thereof is coupled to a low supply voltage source VSS. The organic light emitting diode OLED emits light in accordance with the current Ids between the drain and source of the driving TFT Td. A first capacitor C1 is coupled between the first node N1 and the second node N2. A second capacitor C2 is coupled between the source electrode and drain electrode of the fourth TFT T4.

In one embodiment, the high supply voltage source VDD may be set to supply a high potential DC voltage, and the low supply voltage source VSS may be set to supply a low potential DC voltage. The reference voltage REF is a voltage for initializing the first node N1.

The first node N1 is a contact between the gate electrode of the driving TFT Td, the source electrode of the first TFT T1, and the source electrode of the third TFT T3. The second node N2 is a contact between the source electrode of the driving TFT Td and the drain electrode of the fourth TFT T4.

In one embodiment, the transistors are turned on or turned off in a manner that senses the threshold voltage Vth of the driving transistor Td and prevents the threshold voltage Vth from affecting the amount of current flowing through the driving transistor Td. Initially, the voltage level at N1 is set to the REF voltage level and a voltage at N2 slowly dissipates through transistor Td. The voltage level at N2 is used as an indication of the threshold voltage Vth level. Node N1 is set to a data voltage. The indication of the threshold voltage Vth is transferred from node N2 to node N1 via capacitor C1 to generate an adjusted data voltage level at node N1. As a result, the threshold voltage Vth is reflected in the adjusted data voltage level at node N1. The adjusted data voltage is applied to the gate of driving transistor Td to control the current Ids. Because the threshold voltage Vth is already accounted for in the voltage at N1, VDD does not affect the level of current Ids.

In one embodiment, the values of the capacitors C1 and C2 and the turn on/turn off time of the transistors (e.g., T1 and T2) in the pixel P are tightly controlled and prevents an electron mobility of the drive transistor Td from affecting the amount of current flowing through the driving transistor Td. The careful control of these components results in the voltage at node N1 being finely tuned to a particular adjusted data voltage level. When the voltage at node N1 is then applied to the gate of driving transistor Td to control the current Ids, electron mobility does not affect the level of current Ids. Instead, the current Ids can predictably be determined as a function of the capacitor C1 and C2 values, the Vdata voltage level, and the REF voltage level.

Additionally, it is noted that a display panel has many pixels P, each of which may receives the supply voltage VDD from a common supply voltage VDD source. Due to the size of the panel and the number of pixels drawing power from the supply voltage VDD source, the supply voltage VDD level may not be the same across the entire display panel. Pixels closer to the supply voltage VDD source may receive a higher supply voltage VDD, whereas other pixels may receive a lower supply voltage VDD.

In one embodiment, the operation of pixel P prevents the precise value of supply voltage VDD seen at the pixel P from affecting the amount of current flowing through the driving transistor Td. Specifically, node N2 is set to the supply voltage VDD level seen at the pixel P. The change in voltage caused by setting node N2 to the supply voltage VDD level is applied to node N1 via capacitor C1 to generate the adjusted data voltage level at node N1. As a result, the adjusted data voltage level at node N1 accounts for the level of the supply voltage VDD. When the voltage at node N1 is then applied to the gate of driving transistor Td to control the current Ids, VDD does not affect the level of current Ids.

These and other embodiments are now described in greater detail by reference to FIG. 2.

Figure 2:
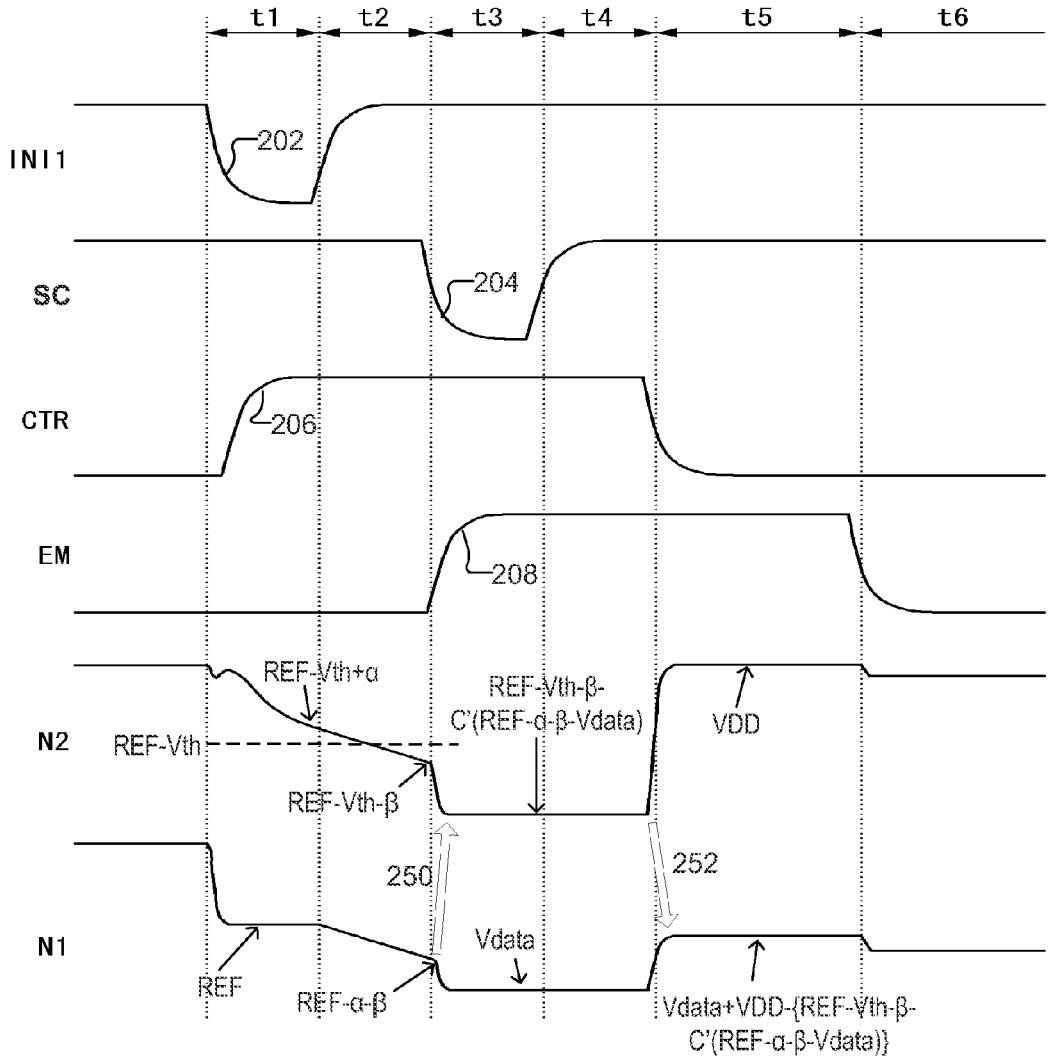
FIG. 2 is a waveform diagram showing signals input to the pixel of FIG. 1 and voltage changes of the first and second nodes, according to the first exemplary embodiment.

FIG. 2 is a waveform diagram showing signals input to the pixel of FIG. 1 and voltage changes of the first and second nodes. FIG. 2 illustrates a first initialization signal INI1, scan signal SC, control signal CTR, and emission signal EM input to a pixel P of the display panel 10. Also, FIG. 2 illustrates the amount of voltage changes of the first node N1 and second node N2 of the pixel P. Note that the waveforms may not be drawn to scale (e.g. N1 and N2 may not be to scale relative to each other).

The first initialization signal INI1, scan signal SC, control signal CTR, and emission signal EM are signals for controlling the first to fourth TFTs T1, T2, T3, and T4 of the pixel P. Each signal swings between a gate low voltage VGL and a gate high voltage VGH. In one embodiment, the gate high voltage VGH is set between about 14V and 20V and the gate low voltage VGL is set between about −12V and −5 v.

As shown in FIG. 2, each signal includes a signal "pulse." The first initialization signal INI1 includes a first initialization pulse 202 during period t1. The scan signal SC includes a scan pulse 204 during period t3. The control signal CTR includes a control pulse 206 during periods t1, t2, t3 and t4. The emission signal EM includes an emission pulse 208 during periods t3, t4 and t5.

The first initialization pulse 202 and the scan pulse 204 SC are generated at a gate low voltage VGL. In contrast, the control pulse 206 and the emission pulse 208 are generated at a gate high voltage VGH. Additionally, the pulses are cyclically generated during every frame period. A frame period refers to a period of time associated with a single image frame. The length of a frame period may be controlled by a refresh rate of the display panel in which the pixel P is being used.

The first initialization pulse 202 and the control pulse 206 are generated before the scan pulse 204 and the emission pulse 208 are generated. The first initialization pulse 202 and the scan pulse 204 have shorter pulse widths than the pulse widths of the control pulse 206 and the emission pulse 208. The first initialization pulse 202 may have the same pulse width as the scan pulse 204. The control pulse 206 and the emission pulse 208 may have the same pulse width.

Hereinafter, the operation of the pixel P according to the first exemplary embodiment during periods t1 to t6 will be described in detail with reference to FIGS. 1 and 2. Generally speaking, during periods t1 and t2, a threshold voltage Vth of the driving TFT Td is sensed and is reflected in the voltage level at node N2. During periods t3 and t4, a data voltage Vdata is received and used to set the voltage at node N1. During period t5, the threshold voltage Vth is transferred to node N1. Additionally, during period t5, a voltage drop of the high supply voltage VDD across the display panel is compensated for. During period t6, the organic light emitting diode (OLED) emits light.

During period t1, the first initialization signal INI1 and emission signal EM are generated to have a gate low voltage VGL. Also, the scan signal SC and control signal CTR are generated to have a gate high voltage VGH.

The first TFT T1 is turned on in response to the first initialization signal INI1 to initialize the first node N1 to the reference voltage REF. The second TFT T2 is turned on in response to the emission signal EM to connect the drain electrode of the driving TFT Td and the anode electrode of the organic light emitting diode OLED. The third TFT T3 is turned off by the scan signal SP. The fourth TFT T4 is turned off by the control signal CTR.

Since the first node N1 is initialized to the reference voltage REF, a voltage difference Vgs between the gate electrode and source electrode of the driving TFT Td becomes larger than the threshold voltage Vth. Current then flows through the TFT Td and slowly decreases the voltage at the source electrode of the driving TFT Td. The decrease is not instantaneous due to non-ideal factors such as the channel resistance of the driving TFT Td during period t1.

If the length of period t1 is infinite, the voltage difference Vgs between the gate electrode and the source electrode would eventually reach the threshold voltage Vth, upon which current would cease flowing through the TFT Td. Accordingly, the voltage of the source electrode of the driving TFT Td (i.e., node N2) would be lowered to the difference voltage REF−Vth between the reference voltage REF and the threshold voltage Vth by the end of period t1 if period t1 is of sufficient length.

However, because t1 has a limited duration, the voltage of the second node N2 may not be exactly lowered to the difference voltage REF−Vth by the end of the period t1. Instead, the voltage of the second node N2 may be lowered to 'REF−Vth+α' by the end of period t1, which is obtained by adding a to the difference voltage REF−Vth. α can be viewed as a predetermined value that represents an error caused by the channel resistance of the driving TFT Td. Therefore, the greater α is, the larger the error is in sensing the threshold voltage Vth with the voltage level at node N2.

Moreover, the electron mobility of the driving TFT Td may correspond to a channel resistance of the TFT Td or the like. For example, the larger the channel resistance, the lower the electron mobility of the driving TFT Td. In other words, the electron mobility of the driving TFT td is related to the value of a because a increases as the channel resistance increases. In one embodiment the electron mobility of the driving TFT Td may be compensated for by controlling the length of t1 such that the voltage at node N2 is equal to 'REF−Vth+α' at the end of period t1, and then controlling the timing of period t2 and the capacitance values of C1 and C2, as will be explained in greater detail.

During the period t2, the emission signal EM is generated to have a gate low voltage VGL. Also, the first initialization signal INI1, scan signal SC, and control signal CTR are each generated to have a gate high voltage VGH.

The second TFT T2 is turned on in response to the emission signal EM. When on, TFT T2 connects the drain electrode of the driving TFT Td and the anode electrode of the organic light emitting diode OLED. The first TFT T1 is turned off by the first initialization signal INI1. The third TFT T3 is turned off by the scan signal SC. The fourth TFT T4 is turned off by the control signal CTR.

The first node N1 is floated during the second period t2. The voltage of the second node N2 discharges through drive transistor Td and the decrease in the voltage at node N2 affects the voltage at floating node N1 since the two nodes N1 and N2 are coupled to each other via the capacitor C1. Hence, the voltage at nodes N1 and N2 gradually decrease together.

The voltage level at N2 drops from 'REF−Vth+α' at the beginning of the period t2 to 'REF−Vth−β' at the end of the period t2. βsimply represents an amount of voltage decrease that occurs after the voltage of node n2 reaches the voltage level of 'REF−Vth'. Thus, as shown by the formula for the voltage at the second node N2, the voltage at N2 continues to reflect the threshold voltage of the driving TFT Td during the second period t2.

The amount of voltage change of the second node during period t2 is '−α−β'. During period t2, this amount of voltage change is applied to the first node N1 through the first capacitor C1. As a result, the voltage of the first node N1 is lowered to 'REF−α−β' by the end of the period t2.

During the period t3, the scan signal SC is generated to have a gate low voltage VGL. Also, the first initialization signal INI1, control signal CTR, and emission signal EM are each generated to have a gate high voltage.

The third TFT T3 is turned on in response to the scan signal SC to supply a data voltage Vdata of the data line DL to the first node N1. The first TFT T1 is turned off by the first initialization signal INI1. The second TFT T2 is turned off by the emission signal EM. The fourth TFT T4 is turned off by the control signal CTR.

During the period t3, the first node N1 is set to the data voltage Vdata. 'REF−α−β−Vdata', which is the amount of voltage change of the first node N1, is applied 250 to the second node N2 through the first capacitor C1. The second node N2 is located between the first and second capacitors C1 and C2 that are coupled in series. Hence, the amount of voltage change in node N2 is based on the ratio of C' as shown in Equation 2:

[Equation 2]

$$C' = \frac{CA1}{CA1 + CA2}$$

In Equation 2, CA1 indicates the capacitance of the first capacitor C1, and CA2 indicates the capacitance of the second capacitor C2. Consequently, the voltage of the second node N2 is lowered to 'REF−Vth−β−C' (REF−α−β−Vdata)' during period t3.

C' can also be viewed as being based on a ratio of the capacitance values of C2 to C1 because the equation 2 can be re-written as 1/(1+CA2/CA1). As will be explained in greater detail, the capacitance values of CA1 and CA2 can be set to values that cancel out the effect of α and β on the light emitted by the LED in period t6.

During the period t4, the first initialization signal INI1, scan signal SC, control signal CTR, and emission signal EM are each generated to have a gate high voltage VGH.

The first TFT T1 is turned off by the first initialization signal INI1. The second TFT T2 is turned off by the emission signal EM. The third TFT T3 is turned off by the scan signal SC. The fourth TFT T4 is turned off by the control signal CTR. The voltage levels of N1 and N2 remain relatively unchanged during period t4.

During period t4, node N1 is effectively floated by turning off both the first TFT T1 and third TFT T3. Period t4 can be viewed as a stabilization period that ensures that node N1 is floating before the fourth TFT T4 is turned on in period T5.

During the period t5, the control signal CTR is generated to have a gate low voltage VGL. Also, the first initialization signal INI1, scan signal SC, and emission signal EM are each generated to have a gate high voltage.

The fourth TFT T4 is turned on in response to the control signal CTR to connect the terminal of the high supply voltage VDD and the second node N2. The first TFT T1 is turned off by the first initialization signal INI1. The second TFT T2 is turned off by the emission signal EM. The third TFT T3 is turned off by the scan signal SC.

At the beginning of period t5, the voltage of the second node N2 rises to the high supply voltage VDD. 'VDD−{REF−Vth−β−C' (REF−α−β−Vdata)}', which is the amount of voltage change of the second node N2, is applied 252 to the first node N1 through the first capacitor C1. Accordingly, the voltage of the first node N1 is increased from Vdata to 'Vdata+VDD−{REF−Vth−β−C' (REF−α−β−Vdata)}'. The voltage at the first node N1 is thus an adjusted data voltage that accounts for both the data voltage Vdata and the voltage threshold Vth.

During the period t6, the emission signal EM is generated to have a gate low voltage VGL. Also, the first initialization signal INI1, scan signal SC, and control signal CTR are generated to have a gate high voltage VGH.

The second TFT T2 is turned on in response to the emission signal EM to connect the driving TFT Td and the organic light emitting diode OLED. The first TFT T1 is turned off by the first initialization signal INI1. The third TFT T3 is turned off by the scan signal SC. The fourth TFT T4 is turned off by the control signal CTR.

At the beginning of period t6, the voltage at node n2 decreases slightly as current begins to flow through the control transistor T4 and down to the OLED. The slight voltage decrease may be caused by a drain-to-source resistance of the control transistor T4. The voltage decrease at node N2 is applied to node N2 through the capacitor C1 and reflected in the adjusted data voltage at node N2. As this voltage decrease is relatively small and does not affect the Vgs voltage of the driving transistor Td, it is omitted from the following discussion for clarity.

During the period t6, the current Ids between the drain and source of the driving TFT Td is supplied to the organic light emitting diode OLED via the second TFT T2. The organic light emitting diode OLED emits light in accordance with the current Ids between the drain and source of the driving TFT Td. The current Ids between the drain and source of the driving TFT Td is represented by Equation 3:

$$I_{ds}=k'\cdot(V_{gs}-T_{th})^2 \quad \text{[Equation 3]}$$

In equation 3, k' indicates a proportionality factor determined by the structure and physical properties of the driving TFT, which is determined by the mobility, channel width, channel length, etc. of the driving TFT Td. Vgs indicates a voltage difference between the gate electrode and source electrode of the driving TFT Td, and Vth indicates a threshold voltage of the driving TFT Td. Vgs−Vth during the period t6 is as shown in Equation 4:

$$Vgs-Vth=[Vdata+VDD-(REF-Vth-\beta-C'(REF-\alpha-\beta-Vdata))-VDD]-Vth \quad \text{[Equation 4]}$$

In Equation 4, the current Ids between the drain and source of the driving TFT Td is derived as shown in Equation 5:

$$I_{ds}=k'[(1-C)\cdot(V\text{data}-\text{REF})+\beta-C'(\alpha+\beta)]^2 \quad \text{[Equation 5]}$$

In Equation 5, if the capacitance CA2 of the second capacitor C2 is set to be four times greater than the capacitance CA1 of the first capacitor C1, C' evaluates to 0.2. By adjusting the lengths of periods t1 and t2, the ratio of α and β can be set to α=4β. If C'=0.2 and α=4β, then β−C'(α+β) evaluates to zero and may be deleted from Equation 5. As a result, the current Ids between the drain and source of the driving TFT Td may be represented by Equation 6:

$$I_{ds}=k'[(1-C')\cdot(V\text{data}-\text{REF})]^2 \quad \text{[Equation 6]}$$

As shown in equation 6, the current Ids between the drain and source of the driving TFT Td supplied to the organic light emitting diode OLED during the period t6 is dependent only on the proportionality factor k', the value of capacitors C1 and C2, data voltage Vdata, and reference voltage REF. The current Ids is not dependent on the threshold voltage Vth of the driving TFT Td. Therefore, the threshold voltage Vth of the driving TFT Td is compensated for.

Also as shown in equation 6, the current Ids between the drain and source of the driving TFT Td supplied to the organic light emitting diode OLED during the period t6 is not dependent on α. Therefore, the electron mobility of the driving TFT Td is compensated for.

Also as shown in equation 6, the current Ids between the drain and source of the driving TFT Td supplied to the organic light emitting diode OLED during the period t6 is not dependent on the supply voltage VDD. Therefore, any drop in the supply voltage VDD across the display panel from one pixel to the next is also compensated for.

Figure 3:
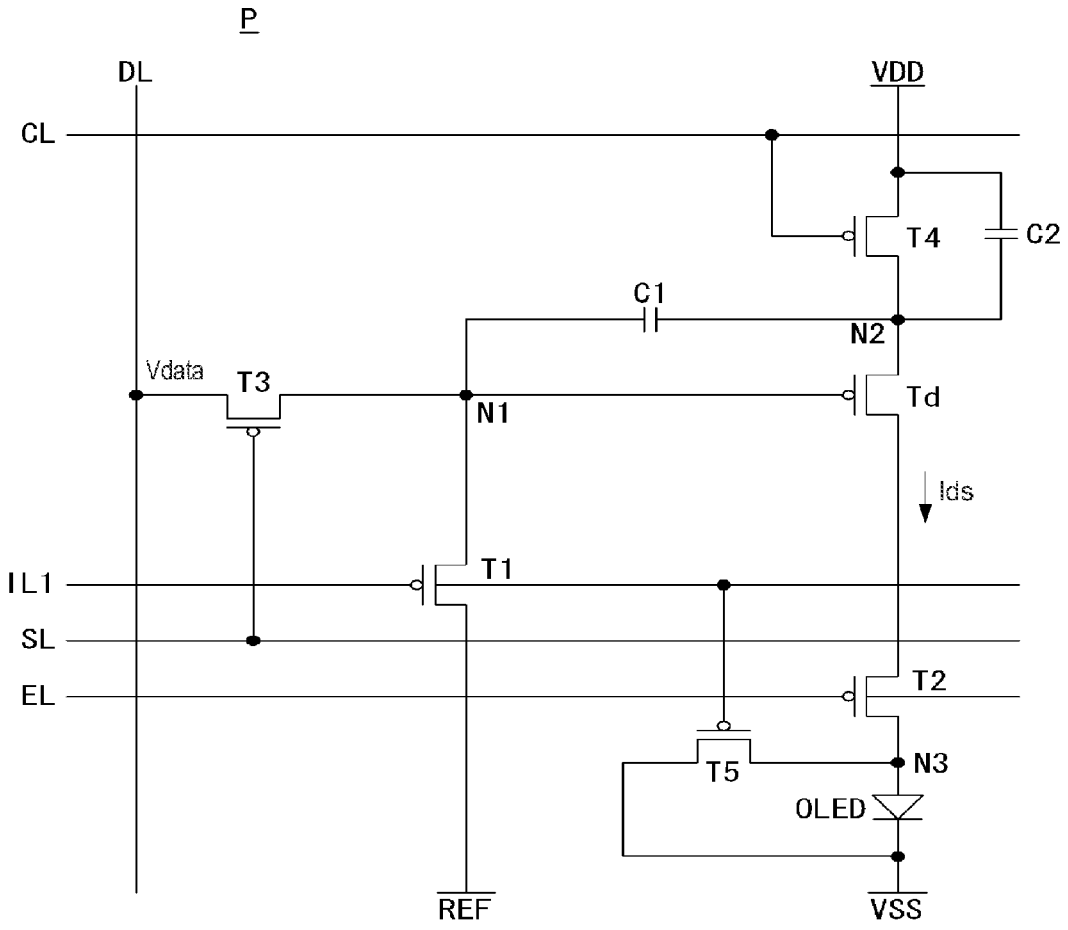
FIG. 3 is an equivalent circuit diagram of a pixel of a display panel according to a second exemplary embodiment.

FIG. 3 is an equivalent circuit diagram of a pixel of a display panel according to a second exemplary embodiment. A control circuit of the pixel P of the display panel 10 according to the second exemplary embodiment comprises a fifth TFT T5 that acts as an OLED bypass transistor. The fifth TFT T5 diverts current away from the OLED during time periods (e.g. period t1) when it is not desirable for the OLED to be emitting light.

The fifth TFT T5 is turned on in response to a first initialization signal INI1 of a first initialization line IL1 to discharge the third node N3 with a low supply voltage VSS. A gate electrode of the fifth TFT T5 is coupled to the first initialization line IL1, a source electrode thereof is coupled to the third node N3, and a drain electrode thereof is coupled to a terminal of the low supply voltage VSS. The third node N3 is a contact among the drain electrode of the second TFT T2, the source electrode of the fifth TFT T5, and an anode electrode of the organic light emitting diode OLED.

The fifth TFT T5 of the pixel P according to the second exemplary embodiment may be composed of a thin film transistor. A semiconductor layer of the fifth TFT T5 may be composed of any one of a-Si, poly-Si, and oxide semiconductor. Moreover, the second exemplary embodiment has been described with an example in which the fifth TFT T5 is implemented as a P-type MOS-FET. In other embodiments, the fifth TFT T5 may be implemented as an N-type MOS-FET.

The remaining configuration of the pixel P of the display panel according to the second exemplary embodiment of FIG. 3 is substantially identical to the first exemplary embodiment shown in FIG. 1. Hereinafter, the operation of the pixel P from FIG. 3 will be described in detail with reference to FIGS. 2 and 3.

During the period t1, the first initialization signal INI1 is generated to have a gate low voltage VGL. The fifth TFT T5 is turned on in response to the first initialization signal INI1 to discharge the third node N3 with the low supply voltage VSS.

Since the anode electrode of the organic light emitting diode OLED is discharged with the low supply voltage VSS due to the turn on of the fifth TFT T5, a sensing current of the driving TFT Td is not supplied to the organic light emitting diode OLED during the period t1. Accordingly, the organic light emitting diode OLED does not emit light during the period t1 due to the sensing current of the driving TFT Td, thereby preventing image distortion and increasing the contrast ratio.

The remaining operation of the pixel P from FIG. 3 during periods t2 through t6 is substantially identical to the first exemplary embodiment which has been described with reference to FIGS. 1 and 2.

Figure 4:
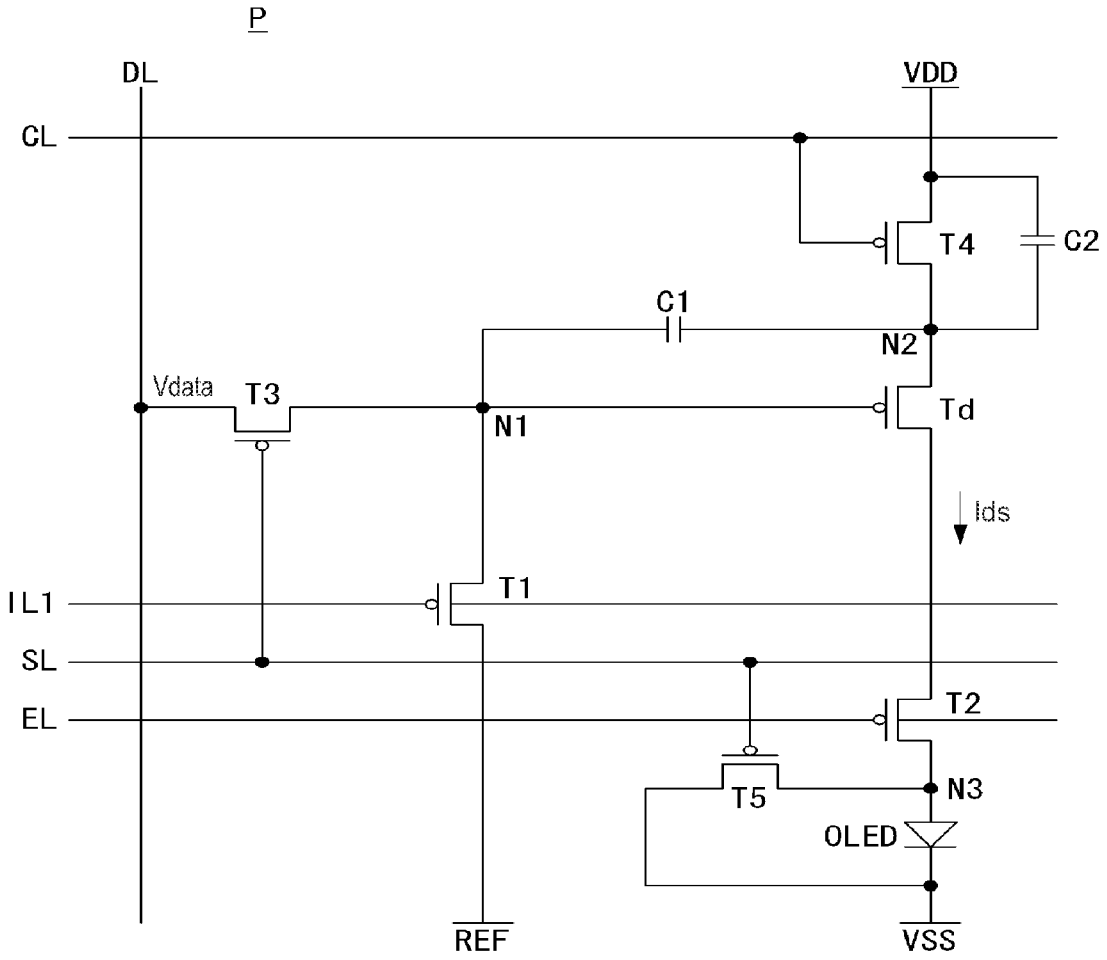
FIG. 4 is an equivalent circuit diagram of a pixel of a display panel according to a third exemplary embodiment.

FIG. 4 is an equivalent circuit diagram of a pixel of a display panel according to a third exemplary embodiment. Referring to FIG. 4, the fifth TFT T5 of the pixel P of the display panel 10 according to the third exemplary embodiment is turned on in response to a scan signal SC of a scan line SL to discharge the third node N3 with a low supply voltage VSS, thereby diverting current from the OLED. A gate electrode of the fifth TFT T5 is coupled to the scan line SL, a source electrode thereof is coupled to the third node N3, and a drain electrode thereof is coupled to a terminal of the low supply voltage VSS.

The remaining configuration of the pixel P of the display panel according to the third exemplary embodiment of FIG. 4 is substantially identical to the first exemplary embodiment which has been described with reference to FIG. 1. Hereinafter, the operation of the pixel P from FIG. 4 will be described in detail with reference to FIGS. 2 and 4.

During the period t3, the scan signal SC is generated to have a gate low voltage VGL. The fifth TFT T5 is turned on in response to the scan signal SC to discharge the third node N3 with the low supply voltage VSS.

Since the anode electrode of the organic light emitting diode OLED is discharged with the low supply voltage VSS due to the turn on of the fifth TFT T5, a leakage current of the driving TFT Td is not supplied to the organic light emitting diode OLED during the period t3. Accordingly, the organic light emitting diode OLED does not emit light during the period t3 due to the leakage current of the driving TFT Td, thereby preventing image distortion and increasing the contrast ratio.

The remaining operation of pixel P from FIG. 4 during periods t1, t2 and t4 through t6 is substantially identical to the first exemplary embodiment which has been described with reference to FIGS. 1 and 2.

Figure 5:
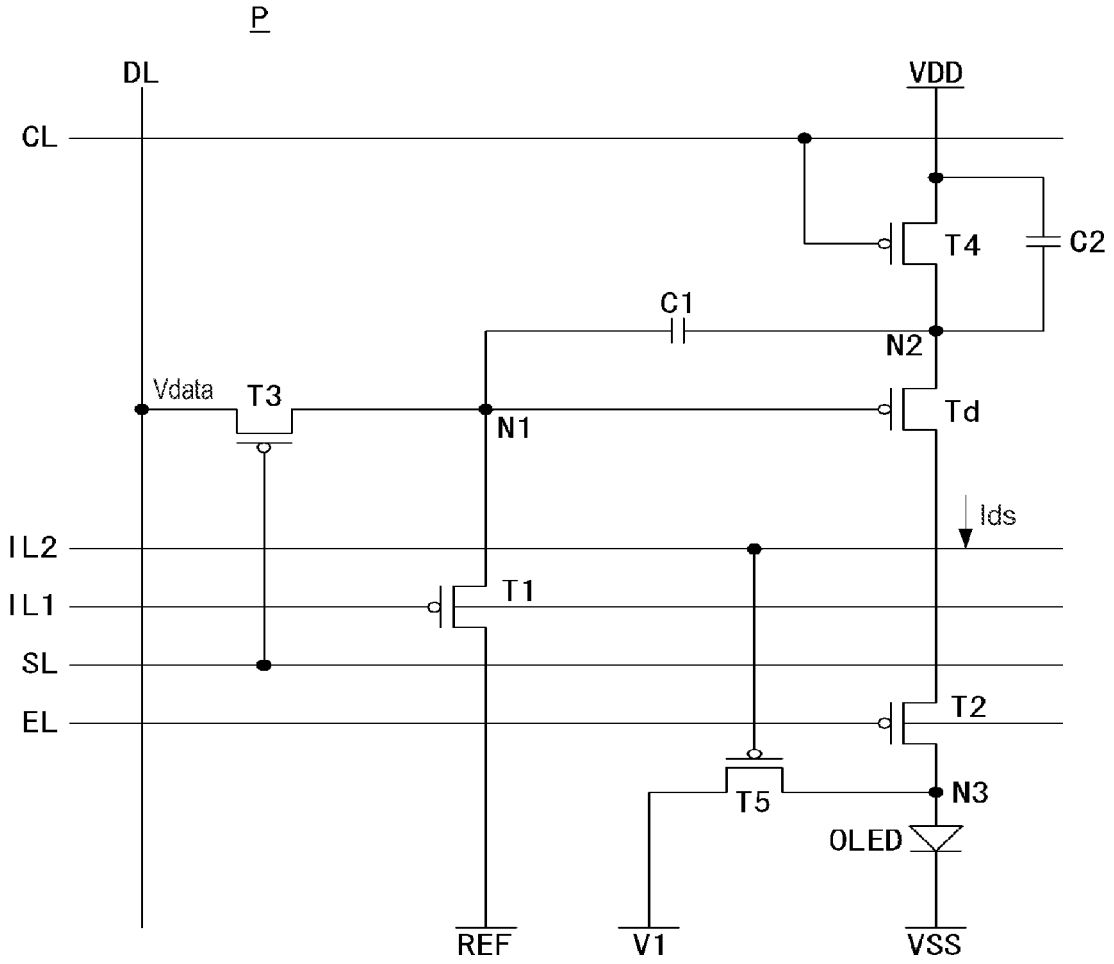
FIG. 5 is an equivalent circuit diagram of a pixel of a display panel according to a fourth exemplary embodiment.

FIG. 5 is an equivalent circuit diagram of a pixel of a display panel according to a fourth exemplary embodiment. Referring to FIG. 5, the fifth TFT T5 of the pixel P of the display panel 10 according to the fourth exemplary embodiment is turned on in response to a second initialization signal INI2 of a second initialization line IL2 to discharge the third node N3 with a first voltage V1. A gate electrode of the fifth TFT T5 is coupled to the second initialization line IL2, a source electrode thereof is coupled to the third node N3, and a drain electrode thereof is coupled to a terminal of the first voltage V1.

The second initialization line IL2 may be formed in parallel with the first initialization line IL1. The first voltage V1 may be set to a voltage lower than a threshold voltage Vth of the organic light emitting diode OLED, for example, a low supply voltage VSS.

The remaining configuration of the pixel P of the display panel according to the fourth exemplary embodiment of FIG. 5 is substantially identical to the second exemplary embodiment which has been described with reference to FIG. 3.

Figure 6:
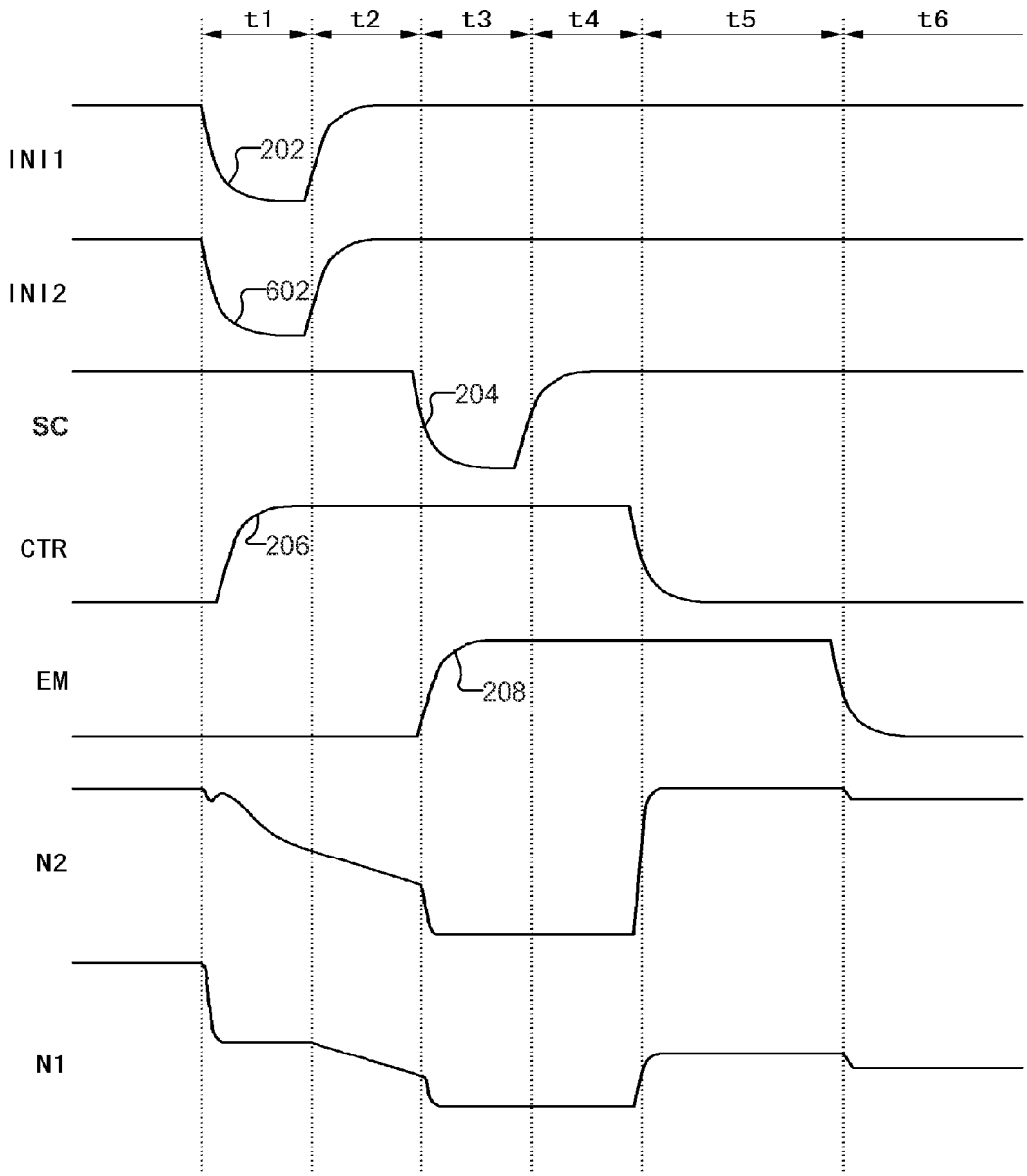
FIG. 6 is a waveform diagram showing signals input to the pixel of FIG. 5 and voltage changes of the first and second nodes, according to the fourth exemplary embodiment.

FIG. 6 is a waveform diagram showing signals input to the pixel of FIG. 5 and voltage changes of the first and second nodes. Referring to FIG. 6, a second initialization signal INI2 is shown with a second initialization pulse 602 during period t1. The second initialization pulse 602 may be repeatedly generated during each frame. Also, the second initialization pulse 602 is generated every frame period. The second initialization pulse 602 is generated at a gate low voltage VGL. The second initialization pulse is generated before the scan pulse 204 and the emission pulse 208 are generated. The second initialization pulse 602 also has a shorter pulse width than the control pulse 206 and the emission pulse 208. The second initialization pulse 602 may have the same pulse width as the first initialization pulse 202, and may be generated in synchronization with the first initialization pulse 202.

The remaining portions of the waveform diagram of FIG. 6 are substantially identical to that described with reference to FIG. 1. Hereinafter, the operation of the pixel P of the display panel 10 according to the fourth exemplary embodiment will be described in detail with reference to FIGS. 5 and 6.

During the period t1, the second initialization signal INI2 is generated to have a gate low voltage VGL. The fifth TFT T5 is turned on in response to the second initialization signal INI2 to discharge the third node N3 with a first voltage V1, thereby diverting current from the OLED.

Since the anode electrode of the organic light emitting diode OLED is discharged with the first voltage V1 due to the fifth TFT T5 being turned on, a sensing current of the driving TFT Td is not supplied to the organic light emitting diode OLED during the period t1. Accordingly, the organic light emitting diode does not emit light during the period t1 due to the sensing current of the driving TFT Td, thereby preventing image distortion and increasing the contrast ratio.

In some embodiments, the second initialization signal INI2 may have a gate low voltage VGL during both periods t1 and t2. The fifth TFT T5 is thus turned on during both periods t1 and t2 to prevent the organic light emitting diode OLED from emitting light during both periods t1 and t2.

The remaining configuration of the pixel P of the display panel according to the fourth exemplary embodiment of FIG. 5 is substantially identical to the first exemplary embodiment which has been described with reference to FIGS. 1 and 2.

Figure 7:
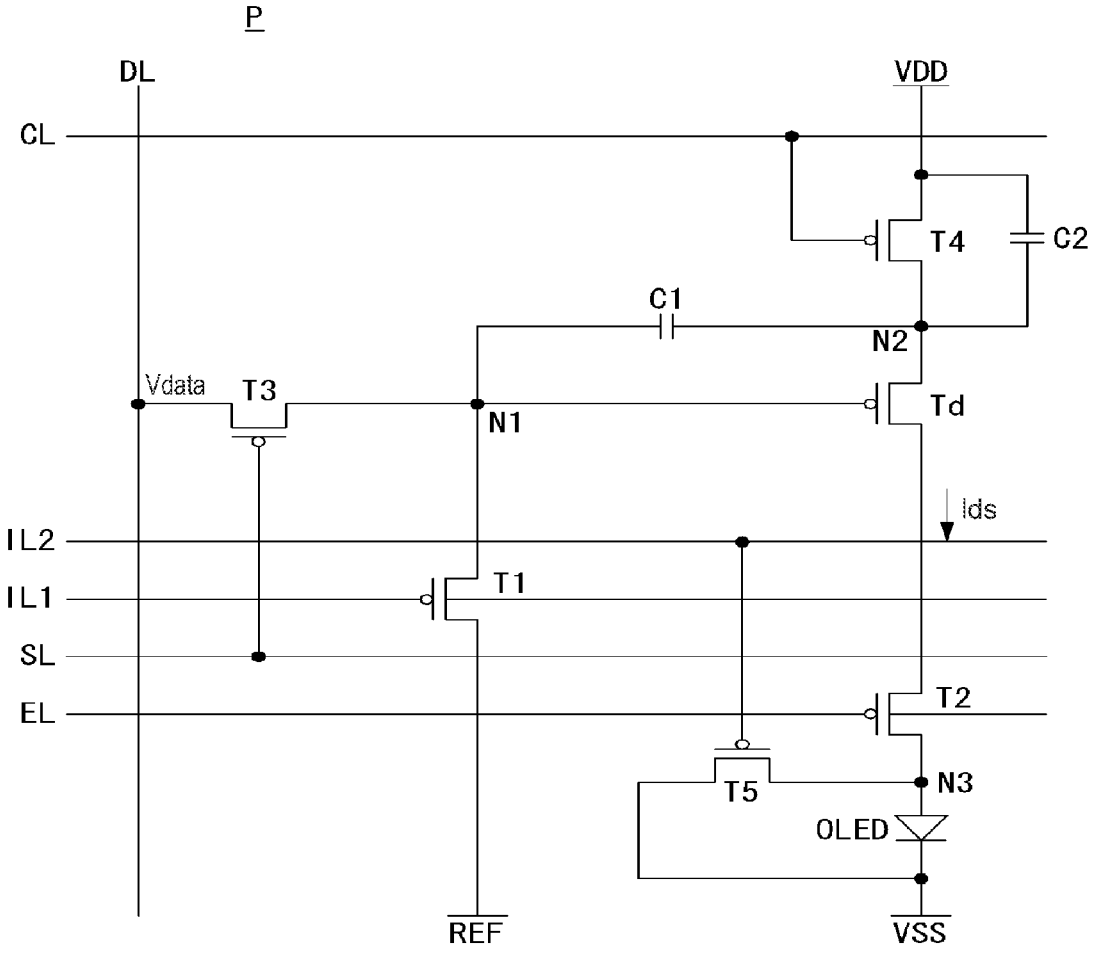
FIG. 7 is an equivalent circuit diagram of a pixel of a display panel according to a fifth exemplary embodiment.

FIG. 7 is an equivalent circuit diagram of a pixel of a display panel according to a fifth exemplary embodiment. Referring to FIG. 7, the fifth TFT T5 of the pixel P of the display panel 10 according to the fifth exemplary embodiment is turned on in response to a second initialization signal INI2 of a second initialization line IL2 to discharge the third node N3 with a low supply voltage VSS. A gate electrode of the fifth TFT T5 is coupled to the second initialization line IL2, a source electrode thereof is coupled to the third node N3, and a drain electrode thereof is coupled to a terminal of the low supply voltage VSS.

The remaining configuration of the pixel P of the display panel according to the fifth exemplary embodiment of FIG. 7 is substantially identical to the fourth exemplary embodiment which has been described with reference to FIG. 5. Hereinafter, the operation of the pixel P of FIG. 7 will be described in detail with reference to FIGS. 6 and 7.

During the period t1, the second initialization signal INI2 is generated to have a gate low voltage VGL. The fifth TFT T5 is turned on in response to the second initialization signal INI2 VGL to discharge the third node N3 with the low supply voltage VSS, thereby diverting current from the OLED.

Since the anode electrode of the organic light emitting diode OLED is discharged with the low supply voltage VSS due to the fifth TFT T5 being turned on, a sensing current of the driving TFT Td is not supplied to the organic light emitting diode OLED during the period t1. Accordingly, the organic light emitting diode does not emit light during the period t1 due to the sensing current of the driving TFT Td, thereby preventing image distortion and increasing the contrast ratio.

The remaining operation of the pixel P of the display panel according to the fifth exemplary embodiment of FIG. 7 is substantially identical to the first exemplary embodiment which has been described with reference to FIGS. 1 and 2.

Figure 8:
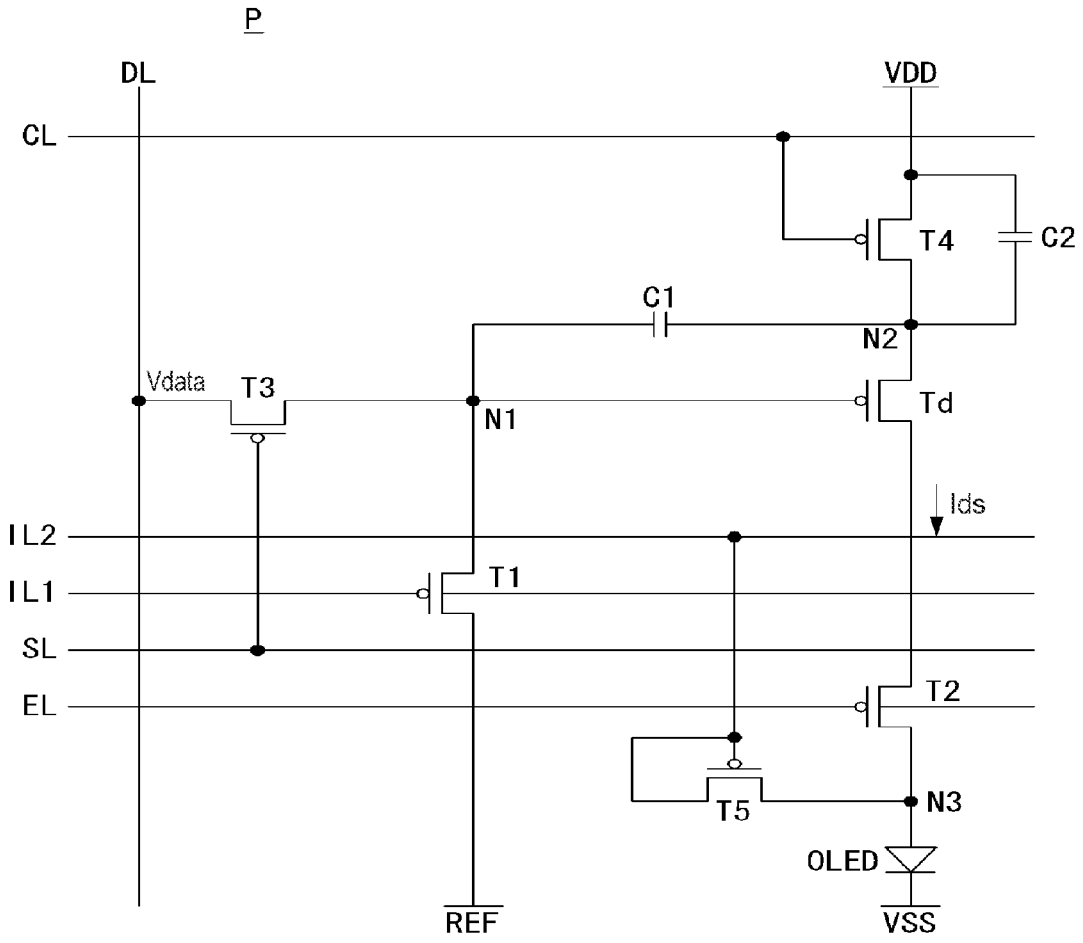
FIG. 8 is an equivalent circuit diagram of a pixel of a display panel according to a sixth exemplary embodiment.

FIG. 8 is an equivalent circuit diagram of a pixel of a display panel according to a sixth exemplary embodiment. Referring to FIG. 8, the fifth TFT T5 of the pixel P of the display panel according to the sixth exemplary embodiment is turned on in response to a second initialization pulse INI2 of a second initialization line IL2 to connect the third node N3 to the second initialization line IL2. A gate electrode of the fifth TFT T5 is coupled to the second initialization line IL2, a source electrode thereof is coupled to the third node N3, and a drain electrode thereof is coupled to the gate electrode. That is, the fifth TFT T5 is diode-connected.

The remaining configuration of the pixel P of the display panel according to the sixth exemplary embodiment of FIG. 8 is substantially identical to the fourth exemplary embodiment which has been described with reference to FIG. 5. Hereinafter, the operation of the pixel P of FIG. 8 will be described in detail with reference to FIGS. 6 and 8.

During the period t1, the second initialization pulse INI2 of the gate low voltage VGL is generated. The fifth TFT T5 is turned on in response to the second initialization pulse INI2 of the gate low voltage VGL to discharge the third node N3 with the gate low voltage VGL, which is the voltage of the second initialization line IL2, thereby diverting current from the OLED.

Since the anode electrode of the organic light emitting diode OLED is discharged with the gate low voltage VGL due to the fifth TFT T5 being turned on, a sensing current of the driving TFT Td is not supplied to the organic light emitting diode OLED during the period t1. Accordingly, the organic light emitting diode OLED does not emit light during the period t1 due to the sensing current of the driving TFT Td, thereby preventing image distortion and increasing the contrast ratio.

The remaining operation of the pixel P of the display panel according to the sixth exemplary embodiment of FIG. 8 is substantially identical to the first exemplary embodiment which has been described with reference to FIGS. 1 and 2.

Figure 9:
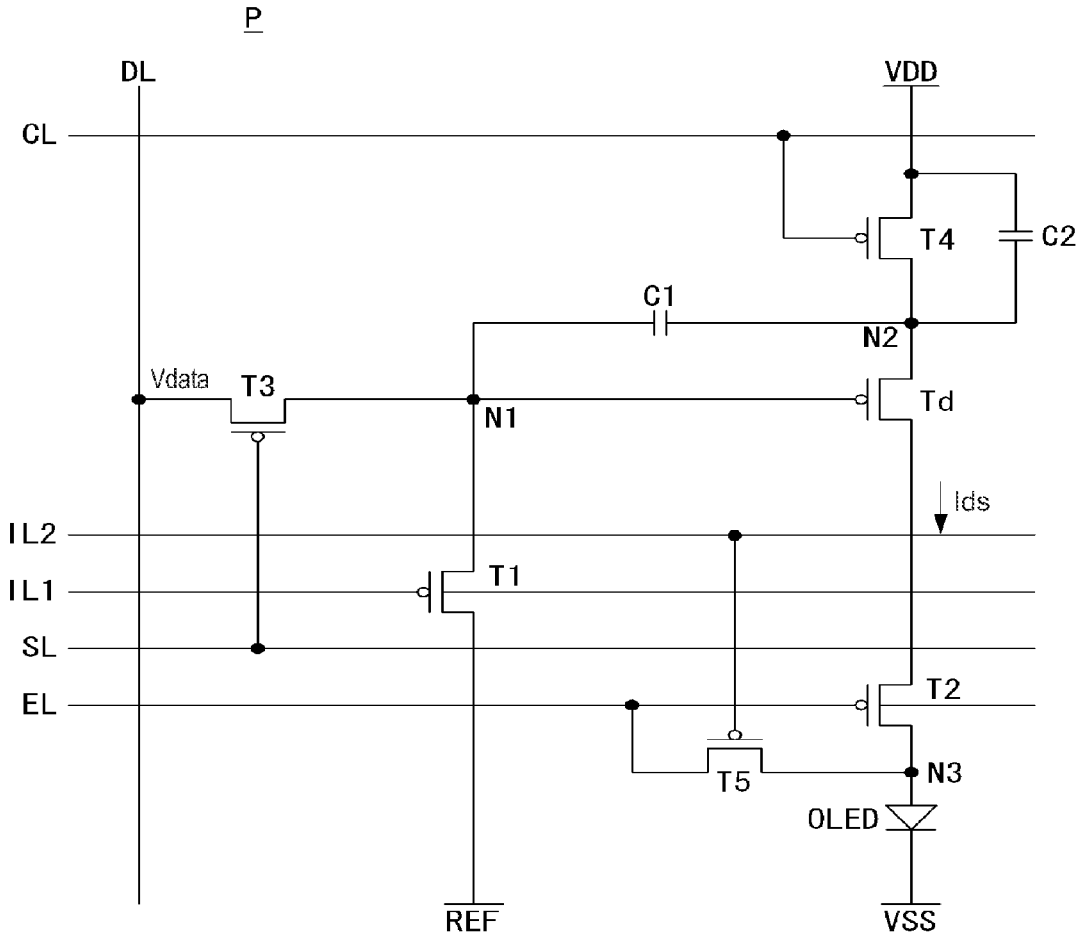
FIG. 9 is an equivalent circuit diagram of a pixel of a display panel according to a seventh exemplary embodiment.

FIG. 9 is an equivalent circuit diagram of a pixel of a display panel according to a seventh exemplary embodiment. Referring to FIG. 9, the fifth TFT T5 of the pixel P of the display panel according to the seventh exemplary embodiment is turned on in response to a second initialization pulse INI2 of a second initialization line IL2 to connect the third node N3 to the emission line EL. A gate electrode of the fifth TFT T5 is coupled to the second initialization line IL2, a source electrode thereof is coupled to the third node N3, and a drain electrode thereof is coupled to the emission line EL.

The remaining configuration of the pixel P of the display panel according to the seventh exemplary embodiment of FIG. 9 is substantially identical to the fourth exemplary embodiment which has been described with reference to FIG. 5. Hereinafter, the operation of the pixel P of the display panel according to the seventh exemplary embodiment will be described in detail with reference to FIGS. 6 and 9.

During the period t1, the second initialization pulse INI2 of the gate low voltage VGL is generated. The fifth TFT T5 is turned on in response to the second initialization pulse INI2 of the gate low voltage VGL to discharge the third node N3 with the gate low voltage VGL, which is the voltage of the emission line EL, thereby diverting current from the OLED.

Since the anode electrode of the organic light emitting diode OLED is discharged with the gate low voltage VGL due to the fifth TFT T5 being turned on, a sensing current of the driving TFT Td is not supplied to the organic light emitting diode OLED during the period t1. Accordingly, the organic light emitting diode OLED does not emit light during the period t1 due to the sensing current of the driving TFT Td, thereby preventing image distortion and increasing the contrast ratio.

The remaining operation of the pixel P of the display panel according to the seventh exemplary embodiment of FIG. 9 is substantially identical to the first exemplary embodiment which has been described with reference to FIGS. 1 and 2.

Figure 10:
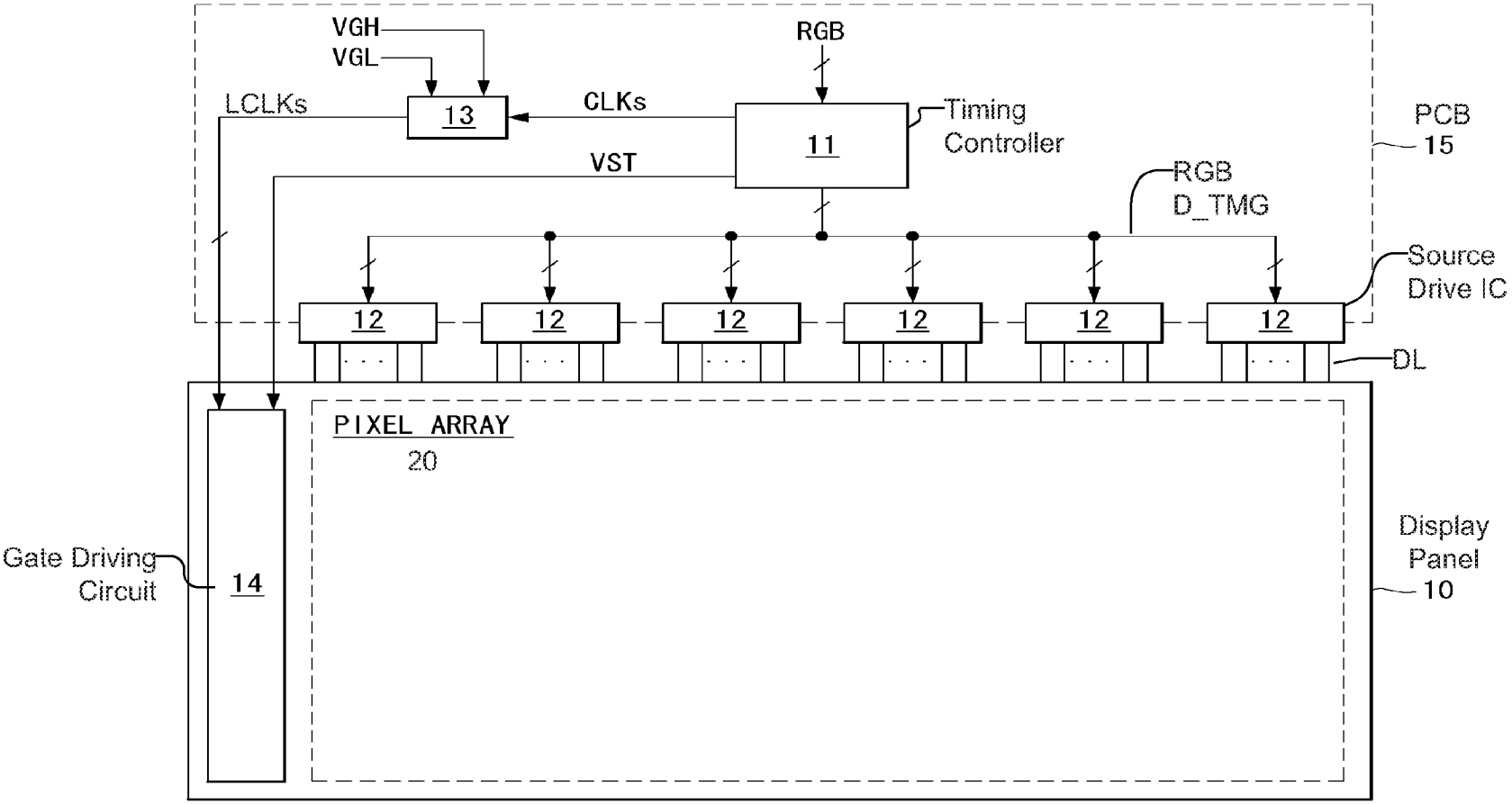
FIG. 10 is a block diagram schematically showing an organic light emitting diode display device according to an exemplary embodiment.

FIG. 10 is a block diagram schematically showing an organic light emitting diode display device according to an exemplary embodiment. Referring to FIG. 10, the organic light emitting diode display device according to the exemplary embodiment comprises a display panel 10, a data driving circuit (e.g., can include Source Drive ICs 12), a gate driving circuit 14, and a timing controller 11.

The display panel 10 has data lines DL and scan lines SL crossing each other (not shown). Also, the display panel 10 has first initialization lines IL1 (not shown), control lines CL (not shown), and emission lines EL (not shown) in parallel with the scan lines SL (not shown). The display panel 10 may additionally have second initialization lines IL2 (not shown) in parallel with the first initialization lines IL1 (not shown). The display panel 10 comprises a pixel array having pixels disposed in a matrix form in cell areas defined by the data lines DL and the scan lines SL. A detailed description of each pixel P of the pixel array of the display panel 10 were previously described by reference to FIGS. 1-9.

The data driving circuit comprises a plurality of source drive ICs 12. The source drive ICs 12 receives digital video data RGB from the timing controller 11. The source drive ICs 12 convert the digital video data RGB into gamma correction voltages to generate data voltages, in response to source timing control signals D_TMG from the timing controller 11, and supplies the data voltages for the data lines DL in the display panel assembly 10 in synchronization with the scan pulses from the gate driving circuit 14. The source drive ICs 12 may be coupled to the data lines DL in the display panel assembly 10 by a COG (chip on glass) process or a TAB (tape automated bonding) process.

A level shifter 13 level-shifts a TTL (transistor transistor logic) level voltage of clocks CLKs output from the timing controller 11, to have the gate high voltage VGH and the gate low voltage VGL. The level-shifted clocks LCLKs are input to gate driving circuit 14.

The gate driving circuit 14 comprises a scan signal output unit (not shown), a first initialization signal output unit (not shown), a control signal output unit (not shown), and an emission signal output unit (not shown). The scan signal output unit is connected to the scan lines SL of the display panel 10. The scan signal output unit outputs a scan signal SC that includes sequential scan pulses. The first initialization signal output unit is connected to the first initialization lines IL1 of the display panel 10. The first initialization signal output unit outputs a initialization signal INI for controlling the initialization of each pixel that includes sequential output initialization pulses. The control signal output unit is connected to the control lines CL of the display panel 10. The control signal output unit outputs a control signal CTR that includes sequential output control pulses. The emission signal output unit is connected to the emission lines EL. The emission signal output unit outputs an emission signal EM that includes emission pulses for controlling light emission of the organic light emitting diodes OLED.

Moreover, the gate driving circuit 14 may further comprise a second initialization signal output unit (not shown). The second initialization signal output unit is connected to the second initialization lines IL2 of the display panel 10. The second initialization signal output unit outputs a second initialization signal INI2 that includes second initialization pulses INI2 to control the supply of voltages lower than the threshold voltage Vth of the organic light emitting diode OLED to the anode electrode of the organic light emitting diode OLED. A detailed description of the scan signals SC, first and second initialization signals INI1 and INI2, control signals CTRL, and emission signals EM were previously described by reference to FIGS. 1-9.

The gate driving circuit 14 may be directly formed on a lower substrate of the display panel 10 by a GIP (gate in panel) scheme. By the GIP scheme, the level shifter 13 may be mounted on a printed circuit board 15, and the gate driving circuit 14 may be formed on a lower substrate of the display panel 10. If the gate driving circuit 14 is connected by the TAB scheme, the gate driving circuit 14 may be connected between the display panel 10 and the timing controller 11.

The timing controller 11 receives digital video data RGB from an external host system via an interface such as an LVDS (low voltage differential signaling) interface, a TMDS (transition minimized differential signaling) interface or the like. The timing controller 11 transmits the digital video data RGB input from the host system to the source drive ICs 12.

The timing controller 11 receives timing signals such as a vertical synchronizing signal Vsync, a horizontal synchronizing signal Hsync, a data enable signal DE, a main clock MCLK, and so forth, from the host system via an LVDS or TMDS interface reception circuit (not shown). The timing controller 11 generates timing control signals for controlling operation timings of the data driving circuit and the gate driving circuit 14 with respect to the timing signals from the host system. The timing control signals comprise gate timing control signals for controlling operation timings of the gate driving circuit 14, and data timing signals D_TMG for controlling operation timings of the source drive ICs 12 and polarities of the data voltages.

The gate timing control signals for the gate driving circuit 14 comprise a start voltage VST and clocks CLKs sequentially generated in the i (i is a natural number over 2) phase. The start voltage VST is input to the gate driving circuit 14 to control shift start timings of the scan signal output unit, first and second initialization signal output units, control signal output unit, and emission signal output unit. The clocks CLKs are input to the level shifter 13 and level-shifted, which are then input to the gate driving circuit 14 as level-shifted clocks LCLK, and are used as clock signals for shifting the start voltage VST.

The data timing control signals D_TMG for the source drive ICs 12 comprise a source start pulse SSP, a source sampling clock SSC, a polarity control signal POL, a source output enable signal SOE, and so on. The source start pulse SSP controls shift start timings of the source drive ICs 12. The source sampling clock SSC is a clock signal which controls data sampling timings with respect to a rising edge or a falling edge in the source drive ICs 12. The polarity control signal POL controls polarities of the data voltages output from the source drive ICs 12. If a data transmission interface between the timing controller 11 and the source drive ICs 12 is a mini LVDS interface, the source start pulse SSP and the source sampling clock SSC may be omitted.

Figure 11:
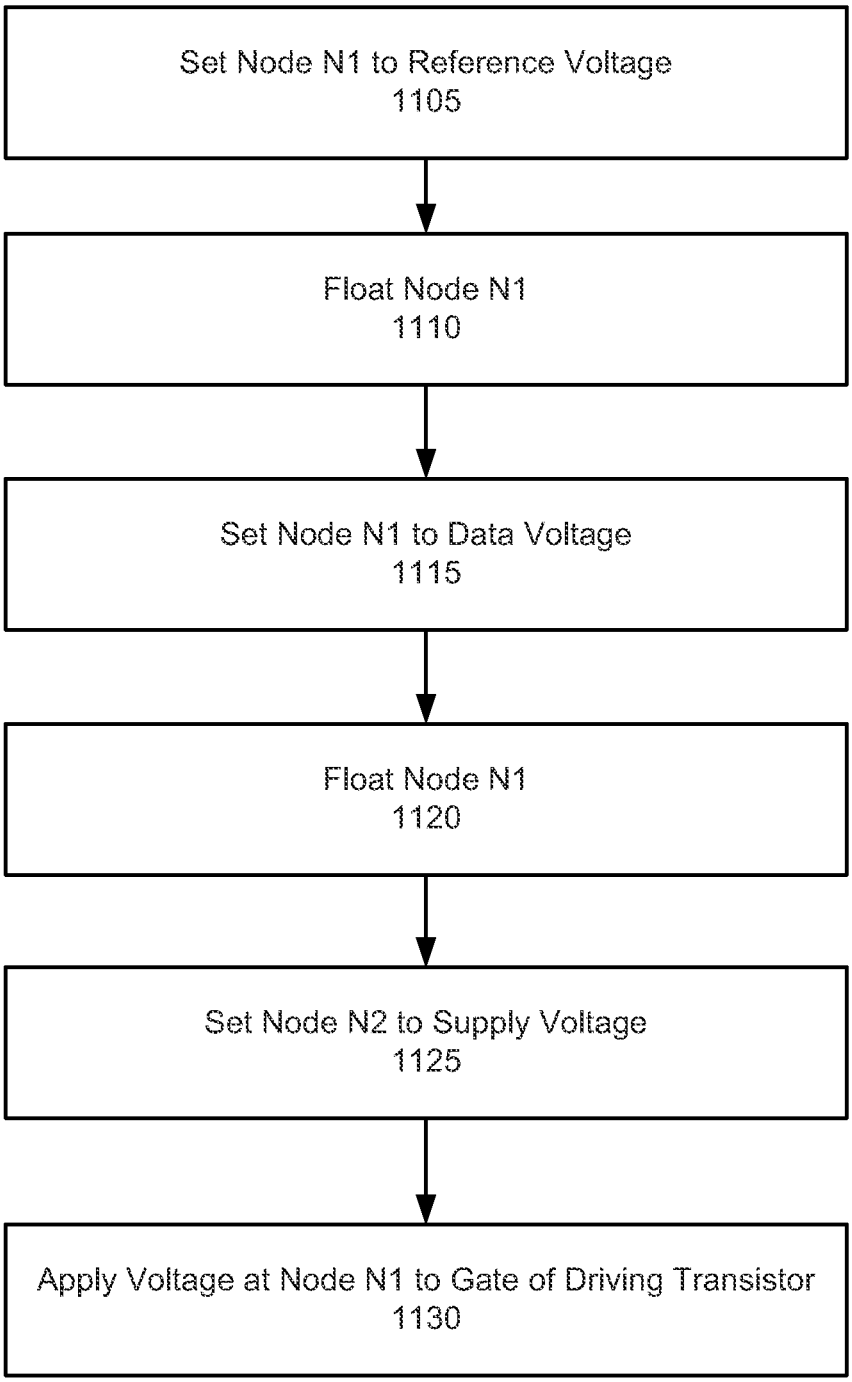
FIG. 11 is a flowchart illustrating a method of operation in a display pixel of a display device, according to an embodiment.

FIG. 11 is a flowchart illustrating a method of operation in a display pixel of a display device, according to an embodiment. Generally speaking, the flowchart describes the embodiments shown in FIG. 1 through FIG. 10.

In step 1105, node N1 is set to a reference voltage REF level by turning on the first Tft T1. Setting node N1 to the reference voltage REF level results in a change in the voltage at node N2. In step 1110, node N1 is floated by turning off the first Tft T1. Floating the first node N1 results in a further change in voltage at the second node N2, which is coupled to the first node N1 via the first capacitor C1. In one embodiment, steps 1105 and steps 1110 can be viewed as sensing steps for sensing the threshold voltage Vth of the driving Tft Td at the second node N2.

In step 1115, node N1 is set to a data voltage Vdata level by turning on the third Tft T3. Setting node N1 to the data voltage Vdata results in a change in the voltage level at node N1. Due to nodes N1 and N2 being coupled via capacitor C1, setting node N1 to the data voltage Vdata also causes a voltage change at node N2. The amount of voltage change at node N2 may be based on the ratio of capacitance values of C1 and C2.

In step 1120, the first node N1 is floated by turning off the third Tft T3.

In step 1125, the second node N2 is set to a supply voltage VDD by turning on the fourth Tft T4. Setting node N2 to the supply voltage VDD causes, via the first capacitor C1, an adjustment in the data voltage Vdata level at node N1 that generates an adjusted data voltage level at node N1. The amount of the adjustment is representative of the threshold voltage Vth of the driving Tft Td. The amount of the adjustment is also representative of the supply voltage VDD level as seen locally by the pixel P. In some embodiments, the adjusted data voltage at node N1 is also generated to account for other voltage drops, such as a voltage drop across the fourth Tft T4 at the beginning of period t6.

In step 1130, the adjusted data voltage at node N1 is applied to the gate of the driving Tft Td to generate current Ids in the OLED. As the adjusted data voltage at node N1 accounts for both Vth of the driving Tft Td and any drop in VDD across the display panel, the amount of current flowing through the driving Tft Td and the OLED is independent of Vth and any drop in VDD across the display panel.

Additionally, a current path between the driving Tft Td and the OLED may be enabled during steps 1105, 1110, and 1130 by turning on the second Tft T2. The current path may be disabled during steps 1115, 1120 and 1125 by turning off the second Tft T2. In one embodiment, current is diverted from the OLED during step 1105 by turning on the fifth Tft T5.

As discussed above, in one embodiment a threshold voltage Vth of the driving TFT is sensed, and the sensed threshold voltage of the driving TFT is applied to the first node N1 of the pixel P through a first capacitor C1, to which the gate electrode of the driving TFT Td is coupled. As a result, the present invention is able to compensate for the threshold voltage of the driving TFT.

Moreover, $\alpha$ associated with the electron mobility of the driving TFT is sensed during the period t1, $\beta$ is sensed during the period t2, and $\alpha$ and $\beta$ are applied to the first node through the first and second capacitors. Also, the length of the first period and the second period and the capacitance ratio of the first and second capacitors can be adjusted in order to compensate for $\alpha$ and $\beta$. As a result, the disclosed pixel P is able to compensate for $\alpha$ and $\beta$ associated with the mobility of the driving TFT Td.

Furthermore, the pixel P comprises a TFT T4 that controls the supply of a high supply voltage VDD to the second node to which the source electrode of the driving TFT Td is coupled. Thus, a voltage drop of the high supply voltage VDD can be applied to the first node N1 through the first capacitor C1. As a result, the pixel P is able to compensate for a voltage drop of the high supply voltage VDD across the display panel.

In addition, the anode electrode of the organic light emitting diode OLED is discharged with a low supply voltage or gate low voltage before the organic light emitting diode OLED emits light. As a result, the pixel is able to prevent light emission caused by a sensing current of the driving TFT before the organic light emitting diode OLED emits light, thereby preventing image distortion and increasing the contrast ratio.

Although embodiments have been described with reference to a number of illustrative examples thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display pixel, comprising:

a first capacitor coupled between a first node and a second node;

an initialization transistor coupled to the first node and configured to set the first node to a reference voltage responsive to turning on of the initialization transistor;

a data transistor coupled to the first node and configured to set the first node to a data voltage responsive to turning on of the data transistor, the data transistor to set the first node to a data voltage after the initialization transistor sets the first node to the reference voltage, and setting the first node to the data voltage causes, via the first capacitor, a voltage change at the second node;

a control transistor coupled to the second node and configured to set the second node to a supply voltage responsive to turning on of the control transistor, wherein setting the second node to the supply voltage causes, via the first capacitor, an adjustment in the data voltage at the first node to generate an adjusted data voltage at the first node; and a driving transistor, a gate of the driving transistor coupled to the first node and a source of the driving transistor coupled to the second node, wherein the adjusted data voltage at the first node is applied to the gate of the driving transistor to control current in a light emitting diode (LED).

2. The display pixel of claim 1, wherein the supply voltage comprises a high potential supply voltage.

3. The display pixel of claim 1, wherein the initialization transistor is turned off to float the first node after the initialization transistor sets the first node to the reference voltage and prior to the data transistor setting the first node to the data voltage.

4. The display pixel of claim 3, wherein the first and second nodes decrease over time in voltage while the first node is floated.

5. The display pixel of claim 3, further comprising:

a second capacitor coupled between the second node and a voltage supply source, wherein the voltage change at the second node is based on a ratio of capacitance values of the first and second capacitors.

6. The display pixel of claim 5, wherein a time at which the initialization transistor is turned off, a time at which the data transistor is turned on, and the values of the first and second capacitors are configured to compensate for an electron mobility of the driving transistor.

7. The display pixel of claim 1, further comprising an emission transistor coupled to the LED and configured to enable a current path between the driving transistor and the LED responsive to turning on of the emission transistor.

8. The display pixel of claim 7, wherein the adjusted data voltage at the first node is also generated to account for a voltage drop when the current path is enabled.

9. The display pixel of claim 1, further comprising a bypass transistor coupled to the LED to divert current from the LED responsive to turning on of the bypass transistor.

10. The display pixel of claim 9, wherein a gate of the initialization transistor is coupled to a first initialization line and a gate of the bypass transistor is coupled to a second initialization line.

11. The display pixel of claim 1, wherein a source of the control transistor is coupled to a supply voltage source, a drain of the control transistor is coupled to the second node, and a gate of the control transistor is coupled to a control line.

12. A display device comprising a plurality of pixels, wherein at least one of the pixels comprises:

a first capacitor coupled between a first node and a second node;

an initialization transistor coupled to the first node and configured to set the first node to a reference voltage responsive to turning on of the initialization transistor;

a data transistor coupled to the first node and configured to set the first node to a data voltage responsive to turning on of the data transistor, the data transistor to set the first node to a data voltage after the initialization transistor sets the first node to the reference voltage, and setting the first node to the data voltage causes, via, the first capacitor, a voltage change at the second node;

a control transistor coupled to the second node and configured to set the second node to a supply voltage responsive to turning on of the control transistor, wherein setting the second node to the supply voltage causes, via the first capacitor, an adjustment in the data voltage at the first node to generate an adjusted data voltage at the first node; and a driving transistor, a gate of the driving transistor coupled to the first node and a source of the driving transistor coupled to the second node, wherein the adjusted data voltage at the first node is applied to the gate of the driving transistor to control current in a light emitting diode (LED).

13. A method of operating a display pixel having a driving transistor, a gate of the driving transistor coupled to a first node and a source of the driving transistor coupled to a second node, the method comprising:

setting the first node to a reference voltage via an initialization transistor of the display pixel;

setting the first node to a data voltage via a data transistor of the display pixel after setting the first node to the reference voltage, the setting of the first node to the data voltage causing a voltage change at the second node;

setting the second node to a supply voltage to cause, via a capacitor coupled between the first and second nodes, an adjustment in the data voltage at the first node that generates an adjusted data voltage at the first node; and applying the adjusted data voltage to the gate of the driving transistor to control current in a light emitting diode (LED).

14. The method of claim 13, further comprising:

floating the first node after setting the first node to the reference voltage but prior to setting the first node to the data voltage.

15. The method of claim 14, further comprising:

enabling a current path between the driving transistor and the LED while (i) the first node is set to a reference voltage, (ii) the first node is floated and (iii) the adjusted data voltage is applied to a gate of the driving transistor; and disabling the current path between the driving transistor and the LED while (i) the first node is set to the data voltage and (ii) the second node is set to the supply voltage.

16. The method of claim 13, further comprising diverting current from the LED while setting the first node to the reference voltage.

17. A display device comprising a plurality of pixels, wherein at least one of the pixels comprises:

a driving transistor adapted to control current in a light emitting diode (LED), a gate of the driving transistor coupled to a first node and a source of the driving transistor coupled to a second node;

a first capacitor coupled between the first node and the second node;

an initialization transistor coupled between the first node and a reference voltage source, the initialization transistor to provide a reference voltage to the first node;

a data transistor coupled between the first node and a data line; and a control transistor coupled between the second node and a supply voltage terminal.

18. The display device of claim 17, wherein the at least one of the pixels further comprises:

a second capacitor coupled between the second node and the supply voltage terminal;

and an emission transistor coupled between the driving transistor and the LED.

19. The display device of claim 18, further comprising:

an initialization line, wherein a gate of the initialization transistor is coupled to the initialization line;

an emission line, wherein a gate of the emission transistor is coupled to the emission line;

a scan line, wherein a gate of the data transistor is coupled to the scan line; and a control line, wherein a gate of the control transistor is coupled to the control line.

20. The display device of claim 19, wherein:

a source of the initialization transistor is coupled to the first node, and a drain of the initialization transistor is coupled to the reference voltage source, a source of the emission transistor is coupled to a drain of the driving transistor, and a drain of the emission transistor is coupled to the LED, a source of the data transistor is coupled to the first node, and a drain of the data transistor is coupled to the data line, and a source of the control transistor is coupled to the supply voltage terminal, and a drain of the control transistor is coupled to the second node.

21. The display device of claim 17, wherein the at least one of the pixels further comprises:

a bypass transistor coupled to the LED and adapted to divert current from the LED.

* * * * *